United States Patent [19]

Gysling et al.

[11] Patent Number: 4,559,031

[45] Date of Patent: Dec. 17, 1985

[54] PASSIVE PAPER STACKER

[75] Inventors: Peter Gysling, Boise, Id.; Sohrab Vossoughi, Vancouver, Wash.

[73] Assignee: Hewlett Packard Company, Palo Alto, Calif.

[21] Appl. No.: 725,530

[22] Filed: Apr. 23, 1985

Related U.S. Application Data

[63] Continuation of Ser. No. 415,005, Sep. 7, 1982, abandoned, which is a continuation of Ser. No. 205,400, Nov. 10, 1980, abandoned.

[51] Int. Cl.[4] ..... B31B 1/00

[52] U.S. Cl. ..... 493/410; 493/413

[58] Field of Search ..... 493/410–413, 493/419–421, 446–448, 451

[56] References Cited

U.S. PATENT DOCUMENTS

| | | | |
|---|---|---|---|
| 2,195,716 | 4/1940 | Clark | 493/420 |
| 2,991,071 | 7/1961 | Hilliker | 493/419 |
| 3,352,553 | 11/1967 | Preston | 493/413 |
| 3,388,641 | 6/1968 | Gobel | 493/419 |
| 3,460,825 | 8/1969 | Mets et al. | 493/411 |
| 4,107,700 | 8/1978 | Jornod | 493/446 X |

OTHER PUBLICATIONS

IBM Technical Disclosure Bulletin, vol. 4, No. 1, Jun., 1961; Fan-Fold Paper Rack; W. K. David.

*Primary Examiner*—John Sipos
*Assistant Examiner*—Steven P. Weihrouch
*Attorney, Agent, or Firm*—Jon R. Stark

[57] ABSTRACT

A passive paper stacker neatly stacks the pages of a sheet of Z-fold paper using only the energy in the falling paper. The first page of the paper is automatically positioned to permit orderly stacking, and diving folds are arrested and redirected toward their proper place on the paper stack.

7 Claims, 11 Drawing Figures

PASSIVE PAPER STACKER

CROSS REFERENCE TO RELATED APPLICATION

This is a continuation of application Ser. No. 415,005, filed Sept. 7, 1982, now abandoned, which was a continuation of Ser. No. 205,400, filed Nov. 10, 1980, now abandoned.

BACKGROUND OF THE INVENTION

Many printing devices are designed to use a long continuous sheet of paper which has been folded to form a series of individual pages. Typically, a folding scheme is used in which inward folds, at which the front sides of adjacent pages face each other, are alternated with outward folds, at which the back sides of adjacent pages face each other. The resulting pattern may be called "Z-fold" because the edges of the pages form a pattern resembling the letter Z.

After pages pass through a printer, it is desirable to stack them neatly to facilitate handling. In the prior art, Z-fold paper was usually allowed to fall into simple trays or wire baskets. One disadvantage of this approach was that the first page of paper often had to be positioned by hand to permit stacking of the following pages. In addition, the edges of the paper had a tendency to "fluff" or remain uncompressed. Another disadvantage was that stacking could be disrupted when a fold landed inward from its proper place at the edge of the stack. This could occur when a page curled as it fell, so that the fold following that page would "dive", that is drop to a position lower than the upper portion of the page. When a diving fold reached the paper stack, it prevented later pages from lying flat.

SUMMARY OF THE INVENTION

In accordance with the preferred embodiment of the present invention, the pages of a sheet of Z-fold paper are neatly stacked using only the energy of the falling paper. Paper output from a printer is guided by an exit ramp toward a base where the paper is automatically stacked. In the preferred embodiment, the base includes a starter ramp for automatically positioning the first page of paper to permit orderly stacking of later pages. Orderly stacking is provided in the preferred embodiment by a set of fold dive arrestors, which catch diving folds and redirect those folds toward their proper positions on the stack of paper.

DESCRIPTION OF THE PREFERRED EMBODIMENT

Figure 1:
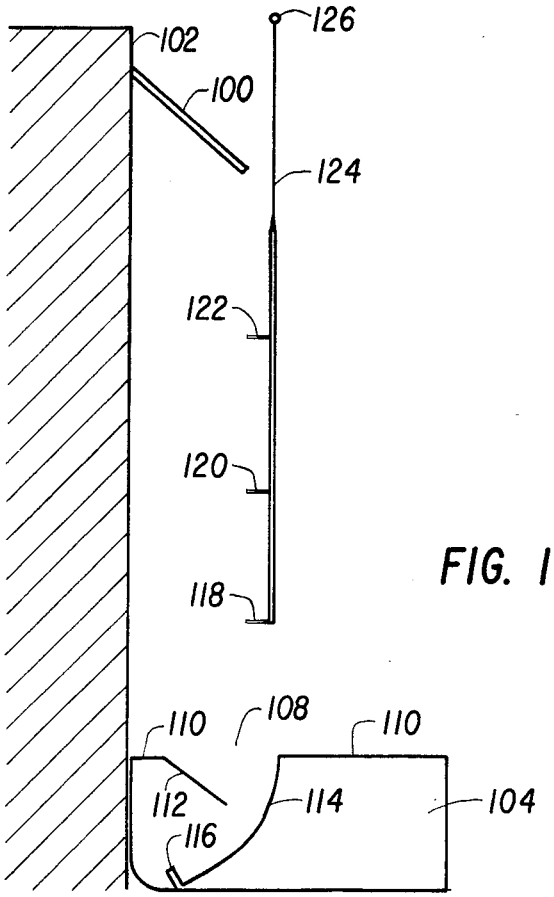
FIG. 1 is a side view of a passive paper stacker with automatic first page positioning and fold dive arresting.

Referring to FIG. 1, an exit ramp 100 is positioned to guide Z-fold paper output as it emerges from a printer

102. Paper passes over exit ramp 100 and falls toward a base 104, where the paper is automatically stacked.

As the first page of paper descends, it passes through a gap 108 in a upper surface 110 of base 104. A guide ramp 112 directs the first page toward a starter ramp 114, which is shaped to position the first page to permit orderly stacking of the successive pages. In the preferred embodiment, starter ramp 114 has a concave shape chosen to optimize automatic starting performance for the anticipated page size. For the commonly used page size of eleven inches, a radius of curvature of about 95 mm is preferred for ramp 114. Guide ramp 112 is preferably placed at an angle of about 37° from the horizontal for eleven inch pages.

At the end of starter ramp 114, a raised edge 116 is provided as a stop to limit movement of the first page along the starter ramp. After the first page is in position against the starter ramp, successive pages are supported by the surface 110. For simple, low-cost construction, base 104, guide ramp 112, and starter 114 may all be molded from polycarbonate material. Many other materials may also be used with satisfactory results provided that the shapes and relative positions of the ramps are chosen to suit the page size.

To correct the trajectories of diving folds, three arresting members 118, 120, and 122 are independently suspended by separate chains 124 from pivots 126. These arresting members catch diving folds and then swing outward, dropping the folds so that the paper will stack in an orderly fashion. When stacking begins, only the lowest arresting member is needed; however, as the height of the stacked paper increases, the action of the lowest arresting member is eventually disabled. The next lowest arresting member then provides fold dive arresting until it is disabled in turn. Three arresting members are provided in the preferred embodiment to permit orderly stacking of a large quantity of paper.

Figure 2A:
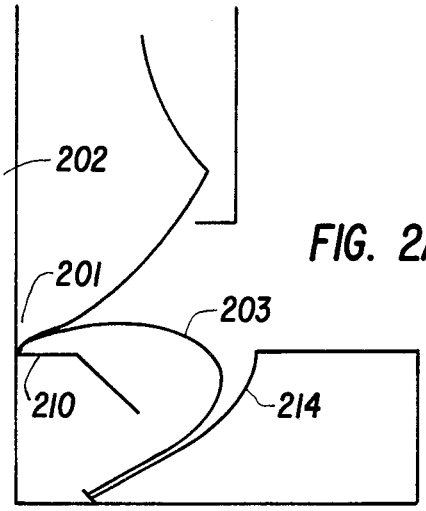
FIGS. 2A and 2B respectively illustrate automatic first page positioning when the first page is followed by an inward fold or an outward fold.
Figure 2B:
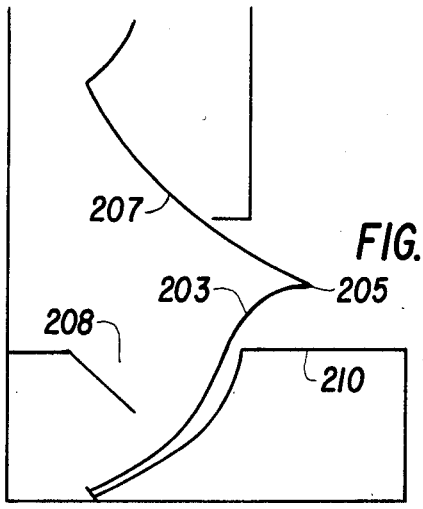

Operation of the starter ramp may be understood by reference to FIGS. 2A and 2B. In FIG. 2A, an inward fold 201 follows first page 203 of a series of pages to be stacked. The shape of starter ramp 214 causes page 203 to curl so that fold 201 lands on surface 210 near printer 202. Later pages will fall into place on top of surface 210 and page 203.

In FIG. 2B, the alternative starting situation is shown where an outward fold 205 follows first page 203. Fold 205 will land on surface 210 so that second page 207 bridges gap 208. Later pages will stack on top of page 207.

Figure 3A:
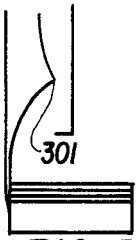
FIGS. 3A, 3B, 3C, 3D, and 3E sequentially illustrate fold dive arresting.
Figure 3B:
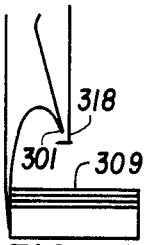
Figure 3C:
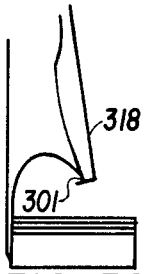
Figure 3D:
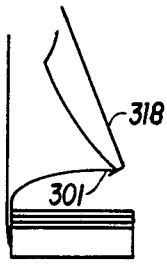
Figure 3E:
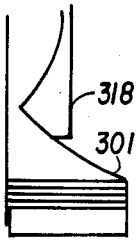

Operation of the fold dive arrestors may be understood by reference to FIGS. 3A, 3B, 3C, 3D, and 3E. In FIG. 3A, fold 301 is beginning to dive. In FIG. 3B, fold 301 is diving toward the center of stack 309. If fold 301 continued to fall without interruption, it would disrupt orderly stacking of later pages; however, arresting member 318 is in position to catch the diving fold. In FIGS. 3C and 3D, arresting member 318 swings outward under the weight of the paper so that fold 301 is redirected toward its proper position on the stack. In FIG. 3E, fold 301 has landed in the proper position on the stack and arresting member 318 has returned to its original position. If a fold does not dive, the paper will simply push the arresting member out of the way as the paper falls.

Figure 4A:
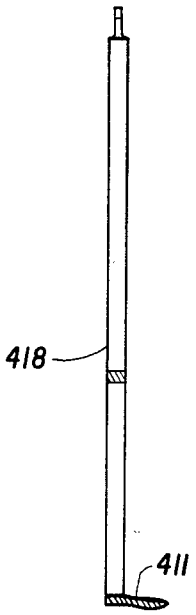
FIGS. 4A and 4B respectively are side and front views of an arresting member.
Figure 4B:
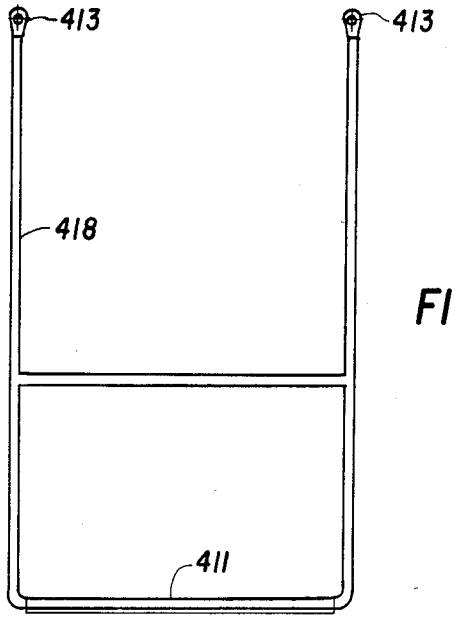

The preferred shape for an arresting member is shown in FIGS. 4A and 4B. In FIG. 4A, a surface 411 of arresting member 418 is shaped to intercept diving folds. In FIG. 4B, eyes 413 are provided for attaching chains to suspend the arresting member.

Figure 5:
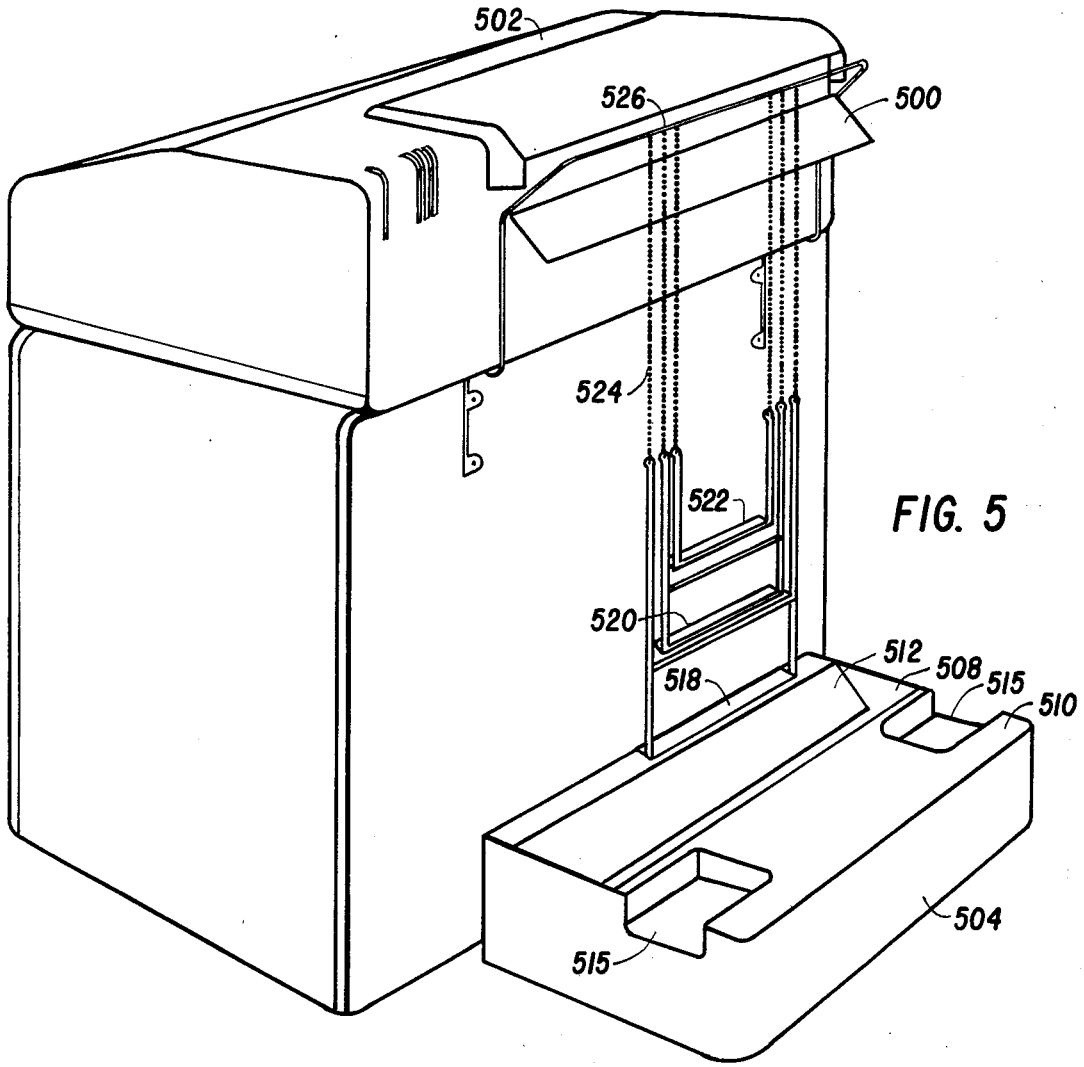
FIG. 5 is a perspective view of a passive paper stacker with automatic first page positioning and fold dive arresting.

Referring to FIG. 5, three arresting members 518, 520, and 522 are suspended by chains 524 from pivots 526. The size of each of these arresting members is chosen so that all three will hang neatly in a nested manner. Paper from printer 502 will pass over exit ramp 500 and stack neatly on surface 510 of base 504. This base is provided with recesses 515 for convenient handling of the stacked paper. Guide ramp 512 is visible through gap 508, but the starter ramp is hidden in FIG. 5 by the sides of the base.

In operation, the starter ramp eliminates the need for manual positioning of the first page of paper to be stacked, while the fold dive arrestors provide orderly stacking of later pages. An advantageous result of fold dive arresting is that the top sheet of the paper stack remains flat, providing a flat stacking surface for the following sheet. Paper may be neatly stacked to a stack height of approximately twenty inches, using only the energy in the following paper.

We claim:

1. A passive paper stacker for stacking a series of pages of a sheet of Z-fold paper comprising:

a base having a horizontal surface for supporting stacked pages, the horizontal surface of the base having a gap for receiving only the first page of the series of pages;

an exit ramp positioned above the base for guiding the series of pages toward the base; and a starter ramp having a sloping concave upper surface extending from and directly beneath the gap, the upper surface including means to force the first page to curl, thereby forcing the fold between the first and second pages to come to rest substantially at an outer edge of the horizontal surface of the base.

2. A passive paper stacker as in claim 1 further comprising at least two arresting members pivotally suspended above the base and having a projecting ledge to catch a diving fold, each arresting member being independently suspended and independently displaceable in an outward swinging arc in reaction to the weight of the paper, the projecting ledge being adapted to release the diving fold when the outward swinging motion of the arresting member has displaced the diving fold to a position from which the fold will fall substantially into alignment with folds of previously stacked pages.

3. A passive paper stacker as in claim 1 further comprising a guide ramp extending beneath the gap for guiding the first page of the series of pages toward the starter ramp.

4. A passive paper stacker as in claim 3 further comprising at least two arresting members pivotally suspended above the base and having a projecting ledge to catch a diving fold, each arresting member being independently suspended and independently displaceable in an outward swinging arc in reaction to the weight of the paper, the projecting ledge being adapted to release the diving fold when the outward swinging motion of the arresting member has displaced the diving fold to a position from which the fold will fall substantially into alignment with folds of previously stacked pages.

5. A passive paper stacker as in claim 3 further comprising stop means for limiting movement of the first page of the series along the starter ramp.

6. A passive paper stacker as in claim 5 further comprising at least two arresting members pivotally suspended above the base and having a projecting ledge to catch a diving fold, each arresting member being independently suspended and independently displaceable in an outward swinging arc in reaction to the weight of the paper, the projecting ledge being adapted to release the diving fold when the outward swinging motion of the arresting member has displaced the diving fold to a position from which the fold will fall substantially into alignment with folds of previously stacked pages.

7. A passive paper stacker for stacking a series of pages of a sheet of Z-fold paper comprising:

a base having a horizontal surface for supporting stacked pages;

an exit ramp positioned above the base for guiding the series of pages toward the base; and at least two arresting members pivotally suspended above the base and each having a projecting ledge to catch a diving fold, each arresting member including independent suspension means for independent free displacement of each said ledge in a swinging arc each said ledge being positioned in its undisplaced position above and between the folded edges of the stack so that upon catching the diving fold on one of said ledges said ledge swings in reaction to the weight of the paper and releases the diving fold when the outward swinging motion of the ledge has displaced the diving fold to a position from which the fold will fall substantially into alignment with folds of previously stacked pages.

* * * * *